US010337690B2

(12) United States Patent
Tessnow et al.

(10) Patent No.: US 10,337,690 B2
(45) Date of Patent: Jul. 2, 2019

(54) AUTOMOTIVE LED MODULE WITH HEAT SINK AND FAN

(71) Applicants: Thomas Tessnow, Weare, NH (US); Ronald Boyd, Jr., Chichester, NH (US); Michael Tucker, Henniker, NH (US)

(72) Inventors: Thomas Tessnow, Weare, NH (US); Ronald Boyd, Jr., Chichester, NH (US); Michael Tucker, Henniker, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 235 days.

(21) Appl. No.: 15/359,276

(22) Filed: Nov. 22, 2016

(65) Prior Publication Data

US 2018/0142861 A1 May 24, 2018

(51) Int. Cl.
*F21S 45/43* (2018.01)
*F21S 41/20* (2018.01)
(Continued)

(52) U.S. Cl.
CPC ..... *F21S 45/43* (2018.01); *F21S 41/148* (2018.01); *F21S 41/28* (2018.01); *F21S 45/47* (2018.01);
(Continued)

(58) Field of Classification Search
CPC ..... F21V 29/713; F21V 29/85; F21S 45/20; F21S 45/43; F21S 45/47; F21S 45/49;
(Continued)

(56) References Cited

U.S. PATENT DOCUMENTS 6,104,609 A * 8/2000 Chen ..... H01L 23/467 165/80.3
6,497,507 B1 12/2002 Weber
(Continued)

FOREIGN PATENT DOCUMENTS

DE 102007043961 A1 * 3/2009 ..... F21V 29/717
DE 102011084114 A1 4/2013
(Continued)

OTHER PUBLICATIONS

Mornet, Single-piece heat sink for optical modules of a lighting and/or signalling device for an automobile, May 19, 2010, Patent Pub EP2187121A1 ; Google Patents, https://patents.google.com/patent/EP2187121A1/en.*
(Continued)

*Primary Examiner* — Anh T Mai
*Assistant Examiner* — Michael Chiang
(74) *Attorney, Agent, or Firm* — Edward S. Podszus

(57) ABSTRACT

Lamp module cooling system 10 contains vehicle solid-state light source 12 coupled to an extruded first heat sink 2 and an extruded second heat sink 20 in thermal communication with one another and with fluid flow directed from fan air outlet 42 of fan 40 over respective heat dissipation first and second ribs 8, 28 to direct warmed air through existing apertures 115 in headlamp bezel 110 aligned with headlamp optics 130 to defog or de-ice headlamp cover 100. Housing cover 30 and cover 32 define air flow path 50, 52, 54 improving warm air guidance and efficient spatial packaging of lightweight lamp module cooling system 10.

22 Claims, 9 Drawing Sheets

(51) Int. Cl.

| | |
|---|---|
| ***F21S 45/47*** | (2018.01) |
| ***F21S 45/49*** | (2018.01) |
| ***F21S 45/60*** | (2018.01) |
| ***F21S 41/148*** | (2018.01) |
| *F21S 41/50* | (2018.01) |

(52) U.S. Cl.
CPC ..... *F21S 45/49* (2018.01); *F21S 45/60* (2018.01); *F21S 41/50* (2018.01)

(58) Field of Classification Search
CPC .. F21S 45/60; F21S 45/67; F21S 45/70; F21S 45/71; F21S 45/74; F21S 45/76
See application file for complete search history.

(56) References Cited

U.S. PATENT DOCUMENTS

| | | | | |
|---|---|---|---|---|
| 7,329,033 | B2 | 2/2008 | Glovatsky et al. | |
| 7,683,395 | B2 | 3/2010 | Huber et al. | |
| 9,115,861 | B2 | 8/2015 | Sieme | |
| 2002/0108743 | A1* | 8/2002 | Wirtz | F28F 13/003 165/185 |
| 2003/0178181 | A1* | 9/2003 | Noda | F28F 3/02 165/80.3 |
| 2009/0154180 | A1* | 6/2009 | Cho | F21V 29/75 362/459 |
| 2009/0262550 | A1* | 10/2009 | Inoue | F21V 29/677 362/547 |
| 2010/0253223 | A1* | 10/2010 | Inoue | F21V 29/02 315/82 |
| 2011/0051453 | A1* | 3/2011 | Nagasawa | B60Q 1/007 362/547 |
| 2011/0310631 | A1 | 12/2011 | Davis | |
| 2012/0062117 | A1* | 3/2012 | Tominaga | F21S 45/47 315/82 |
| 2014/0338878 | A1 | 11/2014 | Tessnow | |

FOREIGN PATENT DOCUMENTS

| | | | |
|---|---|---|---|
| EP | 2020569 B1 | 2/2009 | |
| EP | 2187121 A1 * | 5/2010 | F21V 29/004 |

OTHER PUBLICATIONS

Langebach et. al.; "Illuminating device, has closed air passage provided with essentially horizontal extension, and conveying unit actively conveying air through air passage . . . "; Mar. 19, 2009; Patent DE 102007043961 A1; Google Patents, https://patents.google.com/patent/DE102007043961A1/en.*

* cited by examiner

AUTOMOTIVE LED MODULE WITH HEAT SINK AND FAN

CROSS REFERENCE TO RELATED APPLICATIONS

N/A

TECHNICAL FIELD

The present disclosure relates to heat sinks for solid state illumination systems, and more particularly pertains to compact module with air flow path directing warmed air to defog a headlamp lens cover.

BACKGROUND

While solid state light sources, e.g., light emitting diodes (LEDs) may generate less thermal energy compared to traditional bulbs (e.g., incandescent light bulbs), solid state light sources nevertheless generate thermal energy which should be managed in order to control the junction temperature. A higher junction temperature generally correlates to lower light output, lower luminaire efficiency, and/or reduced life expectancy.

Solid-state illumination systems include heat sinks to dissipate thermal energy away from the solid state light source in order to manage the junction temperature. A two-component heat sink is known in US Pat. Pub. 2014/0338878 (Tessnow). Other examples of heat sinks and air flow are in U.S. Pat. No. 7,683,395 (Huber); U.S. Pat. No. 9,115,861 (Sieme); U.S. Pat. No. 6,497,507 (Weber); U.S. Pat. No. 7,329,033 (Glovatsky); Pub. US2011/0310631 (Davis); and European EP 2 020 569 (Barthel); and German DE 10 2011 084 114 (Wais).

It is known that solid-state light-emitting diodes (LEDs) are efficient and used in automotive low beam and high beam headlamps. Higher power LEDs are now used in such applications, such as those sold by OSRAM Opto Semiconductors under the trade designation Oslon Black Flat S (Model KW HLL531.TE) which has 5 chips generating 2000 lumens and a 20 Watt thermal load (28 total electrical Watts, 8 Watts emitted as light). Such LEDs need relatively large heat sinks. Since it is desired that the headlamps are moveable so as to be aimed, the heat sinks are internal to a sealed housing. The heat sinks for such large thermal loads are large and heavy, consuming about 500 grams of aluminum, which presents a lampset packaging problem. Simultaneously, however, the thermal power of these LEDs is nonetheless too small to melt ice or defog lenses as was commonly done by the traditional but less efficient filament incandescent or halogen lamps. Even when using the higher power LEDs and passive heat sinks the radiated heat remains behind the headlamp housing's bezel which conceals the light source and the front lens cover stays relatively cool. Conventional solutions have involved hot air generating fans with complicated air ducts that required breaking holes into the bezel, undesirable from a standpoint of a vehicle manufacturer's styling goals.

BRIEF DESCRIPTION OF THE DRAWINGS

Features and advantage of the claimed subject matter will be apparent from the following description of embodiments consistent therewith, which description should be considered in conjunction with the accompanying drawings, wherein:

DETAILED DESCRIPTION

By way of an overview, one aspect consistent with the present disclosure features an extruded heat sink as part of a vehicle solid-state lamp module cooling system that incorporates a fan to direct air across the heat-dissipating ribs.

The heat sink of the present disclosure provides numerous benefits and solves several problems. For example, while cast aluminum heat sinks are inexpensive and allow complex heat sink shapes, cast aluminum has a low thermal conductivity (e.g., about 90 W/mK) which may not be able to transfer enough thermal energy away from the solid state light source to maintain the desired junction temperature. While present inventors are aware of some cast aluminum heat sink material having a somewhat higher thermal conductivity (e.g., about 120 W/mK) than conventional cast aluminum, it is considered exotic and expensive, and for practical purposes extruded aluminum is considered to have a thermal conductivity about twice that of cast aluminum. Additionally, the low thermal conductivity of cast aluminum may require the cast aluminum heat to be unacceptably bulky and/or heavy. While extruded aluminum heat sinks have substantially higher thermal conductivity compared to cast aluminum heat sink (e.g., about 200 W/mK), extruded aluminum heat sinks suffer from limited design flexibility. For example, the shape of extruded aluminum heat sinks is generally limited to a symmetric shape unless post-extrusion machining (e.g., to include mounting holes and/or irregular shapes) is utilized. Unfortunately, the post-extrusion machining adds cost to the heat sink and can limit high volume production. Further details are disclosed in US Pat. Pub. 2014/0338878 (Tessnow), incorporated by reference herein.

The heat sink of the present disclosure solves certain disadvantages and limitations discussed above. The heat sink is preferably formed in two parts which are coupled together, each part being preferably of extruded aluminum component (and its relatively high thermal conductivity) and is able to effectively and efficiently spread the thermal energy of the solid state light source across the heat sink. A fan is arranged to direct air across heat dissipating ribs of each heat sink. Moreover, extruded aluminum heat sinks are relatively inexpensive, and expensive post-manufacture machining may be minimized because of the simplicity of joining the two pieces by drilling simple through-holes in each extruded heat sink to receive bolts, whereby two bolts join the two heat sinks together and to a housing, further reducing the manufacturing cost of the module.

Figure 1:
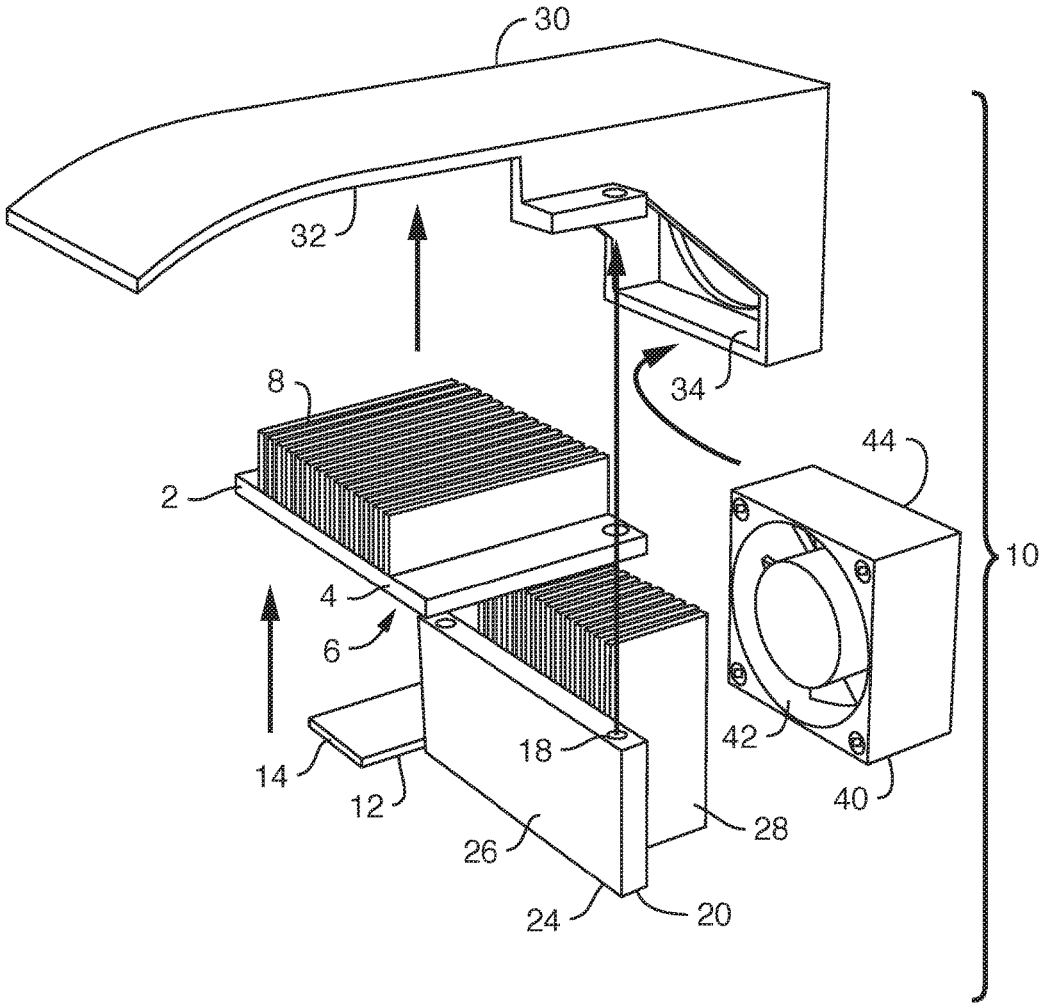
FIG. 1 illustrates a present embodiment in exploded top perspective view.
Figure 2:
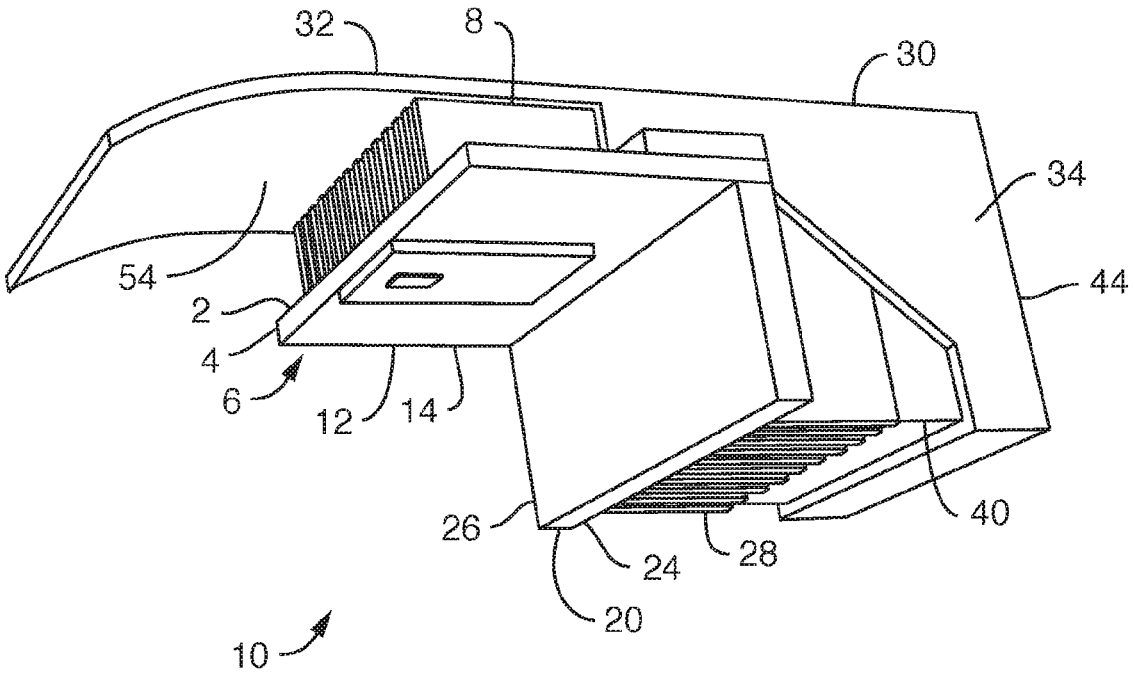
FIG. 2 illustrates a view of FIG. 1 in assembled, bottom perspective view.

Turning now to FIG. 1 and FIG. 2, one embodiment of a vehicle solid-state lamp module cooling system 10 consistent with the present disclosure is generally illustrated as an exploded perspective view. The cooling module 10 includes first heat sink 2 and second heat sink 4 that are thermally coupled to each other. First heat sink component 2 has first base 4 having a first exposed surface 6. With lamp module cooling system 10 mounted in operational relationship on a headlamp frame 120, first exposed surface 6 is directed toward reflector optic 130. Heat dissipation first ribs 8 extend away from first base 4. First heat dissipation ribs 8 are preferably formed integral with first base 4. The first base 4 and first heat dissipation first ribs 8 are preferably formed integral of extruded material. First ribs 8 define air flow channels 50.

FIG. 1 also shows cooling module 10 having second heat sink component 20 which has second base 24 having a second exposed surface 26. Heat dissipation second ribs 28 extend away from second base 24. Second heat dissipation ribs 28 are preferably formed integral with second base 24. The second base 24 and second heat dissipation first ribs 28 are preferably formed integral of extruded material. Second ribs 28 define air flow channels 50, 52. Suitable holes drilled as a first post-extrusion machining step in first base 4 and second base 24 permit two bolts 18, 18 to couple heat sinks 2, 20 in thermal communication with one another. As shown in FIG. 1, a second post-extrusion machining step is performed on second heat sink 20 by cutting away a portion of second base 24 in order that first base 4 seats transversely to second base 24.

First base 4 is disposed transverse to second base 24, such as being perpendicular, or substantially perpendicular, to second base 24. Thus first ribs 8 and second ribs 28 abut and collectively define continuous air flow paths that wrap around the rear faces (opposite first and second exposed surfaces 6, 26) of first and second heat sinks 2, 20.

The extruded first heat sink component 2 is formed from any suitable first material which includes any alloy thereof that can be extruded. The extruded second heat sink component 20 is formed from any suitable second material, including an alloy thereof, which can be extruded. Preferably first heat sink component 2 and first ribs 8 are formed from a first aluminum material which includes any aluminum alloy that can be extruded. Preferably second heat sink component 20 and second ribs 28 are formed from a second aluminum material which includes any aluminum alloy that can be extruded. The second aluminum material may be the same as or different than the first aluminum material, but is preferably the same aluminum material. Examples of the first and/or second aluminum materials may include, but are not limited to, AA 6061 (as designated by the Aluminum Association), AA 6063, or the like. Of course, these are just examples, and the present disclosure is not limited to any particular aluminum material unless specifically claimed as such. The use of aluminum materials for both the extruded first heat sink component 2 and the second heat sink component 20 allows the lamp module cooling system 10 of the present disclosure to be manufactured inexpensively compared to other heat sink designs while still allowing the heat sinks 2, 20 to dissipate enough heat for use in high-power solid state lighting applications with limited space and/or weight constraints. Having both first and second heat sinks 2, 20 formed of aluminum rather than one of aluminum and e.g. the other of a different material, e.g. copper, avoids adjacent materials having different electrode potentials, thus minimizing the likelihood of galvanic corrosion.

It could be considered ideal if it were possible to form the combined shape of first and second heat sinks 2, 20 as one integral piece, but the complex shape and, in preferred embodiments, near 90-degree angle from their mutually orthogonal arrangement likely prevents such a piece from being extruded integrally. Furthermore, if such an integral piece were molded, as noted above, existing cast aluminum or cast magnesium would have a significantly lower thermal conductivity than extruded aluminum, and even if that shape could be integrally molded, the thin fins on both surfaces could not wrap around so costly and extremely precise post-mold machining would be required.

The extruded heat sink components 2, 20 may have any profile which can be extruded. For example, first and second heat sinks 2, 20 may have the same cross-sectional profile along at least one dimension (e.g. the same cross-sectional profile along the length). For example, the first and second heat sinks 2, 20 include one or more ribs or fins 8, 28 extending outward to increase the surface area of the respective first and second heat sink 2, 20 to dissipate thermal energy. The heat-dissipating fins 8, 28 are co-extruded with respective bases 4, 24 of the first and second heat sink components 2, 20.

Figure 7:
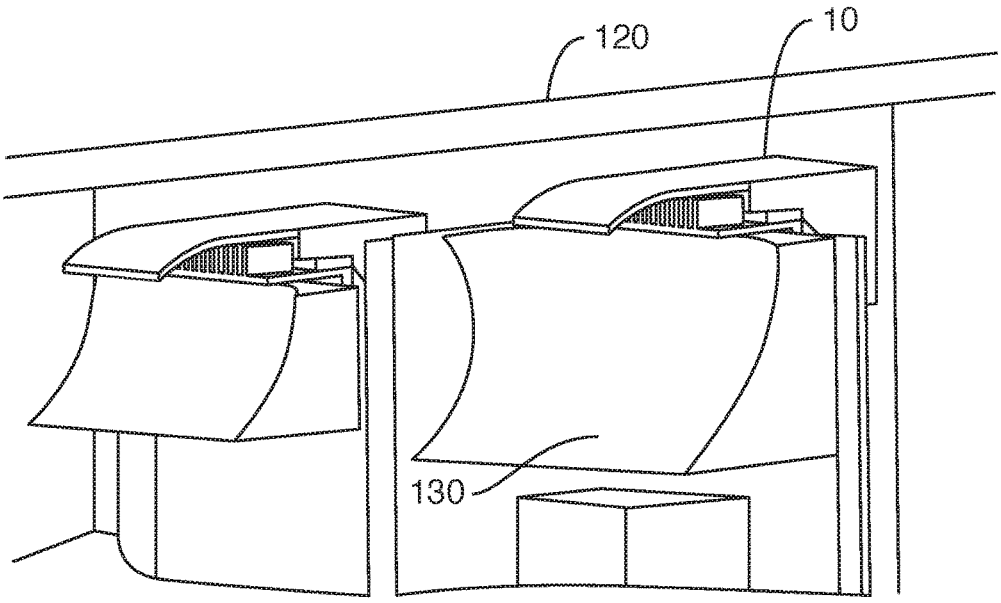
FIG. 7 illustrates a front perspective view of two lamp module cooling systems 10 mounted in a headlamp.
Figure 8:
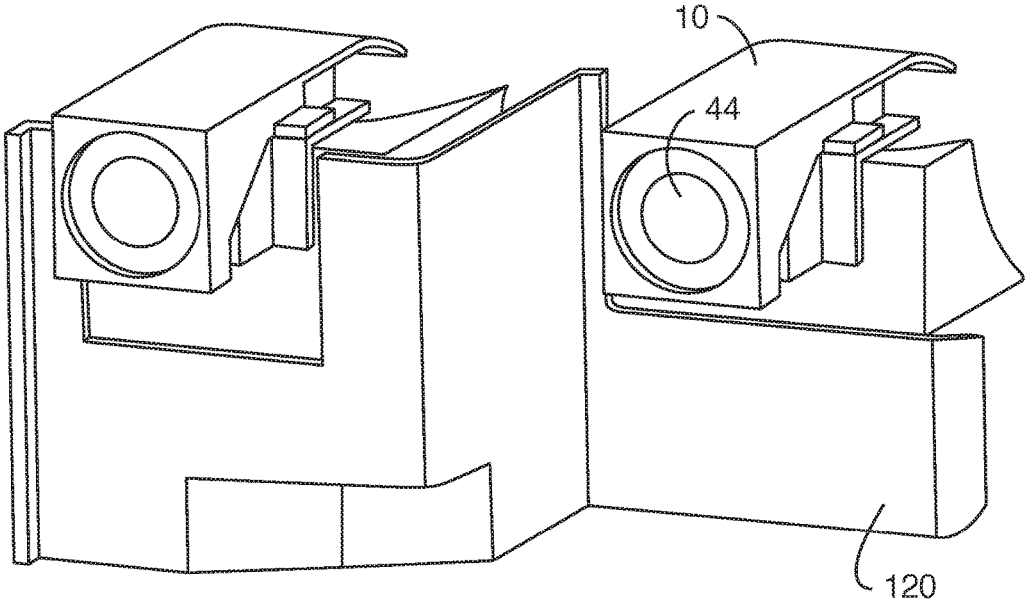
FIG. 8 illustrates a rear perspective view of FIG. 7.

FIGS. 1-2 also show a solid-state light source 12, such as light-emitting diodes (LEDs) mounted on printed circuit board (PCB) 14 which is coupled to first exposed surface 6 as a mounting surface. PCB 14 is of any desired conventional construction, such as a metal core board (MCPCB) known to those in the art that supplies electrical connection to LEDs 12 and provides a mounting surface and permits thermal transfer to first heat sink 2. Exemplary LEDs 12 are high-powered LEDs such as those sold by OSRAM Opto Semiconductors under the trade designation Oslon Black Flat S (Model KW HLL531.TE) which has 5 chips generating 2000 lumens and a 20 Watt thermal load (28 total electrical Watts, 8 Watts emitted as light). In operational position with lamp module cooling system 10 mounted on headlamp frame 120, light source 12 is directed toward reflector optic 130 (FIG. 7). FIGS. 1-2 shows light source 12 coupled to first exposed surface 6. Optionally light source 12 is coupled to second exposed surface 26 (not shown) if the headlamp system optics arrangement is suitable therefore.

Fan 40 is in fluid communication with first heat sink 2 and second heat sink 20. Fan 40 has fan air inlet 44 and fan air outlet 42. Fan 40 is preferably an axial fan, though in other embodiments fan 40 could be configured as a radial fan. Fan 40 is preferably disposed with its air outlet 42 in confronting relation to second heat sink 20, in particular to heat dissipation second ribs 28 which form flow channels. In other embodiments, not shown, fan 40 could be disposed with air outlet 42 in confronting relation to first heat sink 2, such as in confronting relation to heat dissipation first ribs 8. In a preferred embodiment fan 40 is coupled to housing 30 in which it is securely held at a rearward cavity region 34 thereof, housing 30 being attached by bolts 18 to hold first and second heat sinks 2, 20. Fan 40 can provide sufficient airflow of about 9 cfm (cubic feet per minute) operating at full voltage (12V) and provides enough flow that the lamp module cooling system 10 still operates well at low voltage (9V) conditions. Fan 40 can be mounted to housing 30 with additional screws but in a preferred embodiment housing 30 has a receptacle or receiving cavity 34 at a rearward location that accommodates fan 40 with second heat sink 20, such as by shape or slight friction fit. Housing 30 is molded of suitable thermoplastic material such as polycarbonate or other high-temperature resistant plastic. Housing 30 has mounting regions to couple to vehicle headlamp frame 120.

Figure 3:
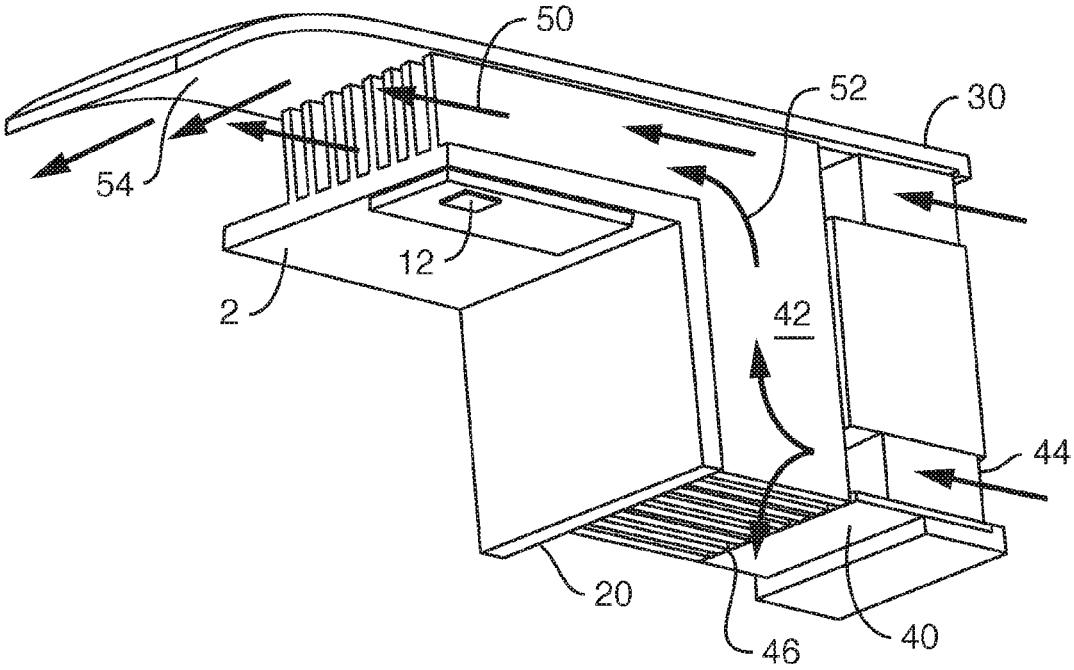
FIG. 3 illustrates air flow channels thereof.
Figure 4:
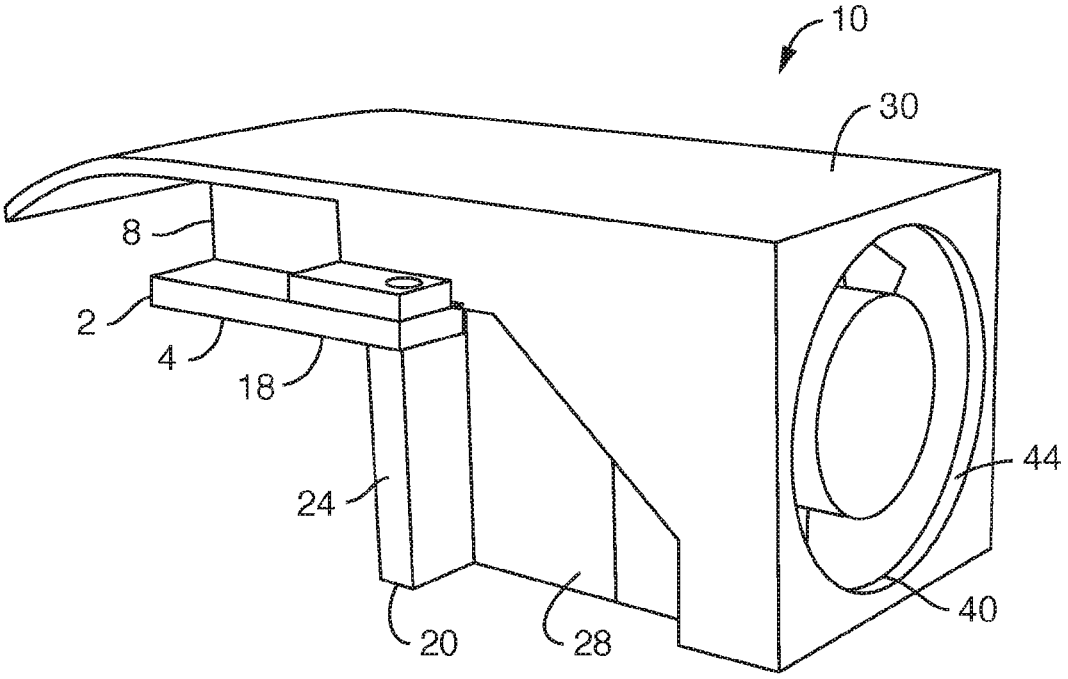
FIG. 4 illustrates a rear perspective view thereof.
Figure 5:
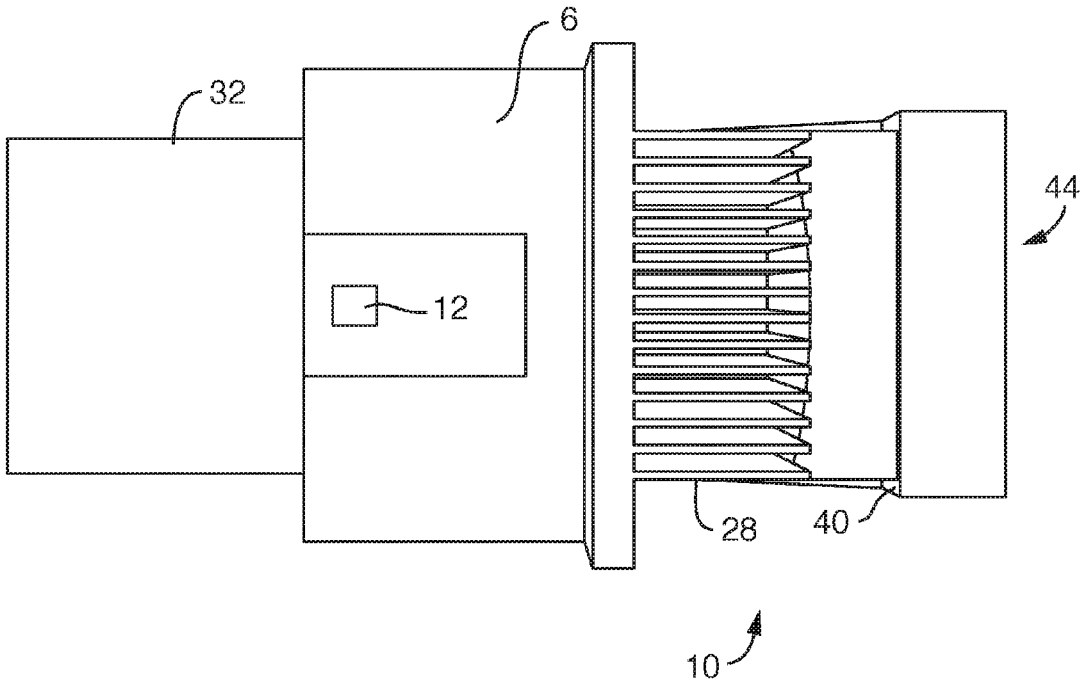
FIG. 5 illustrates a bottom view thereof.
Figure 6:
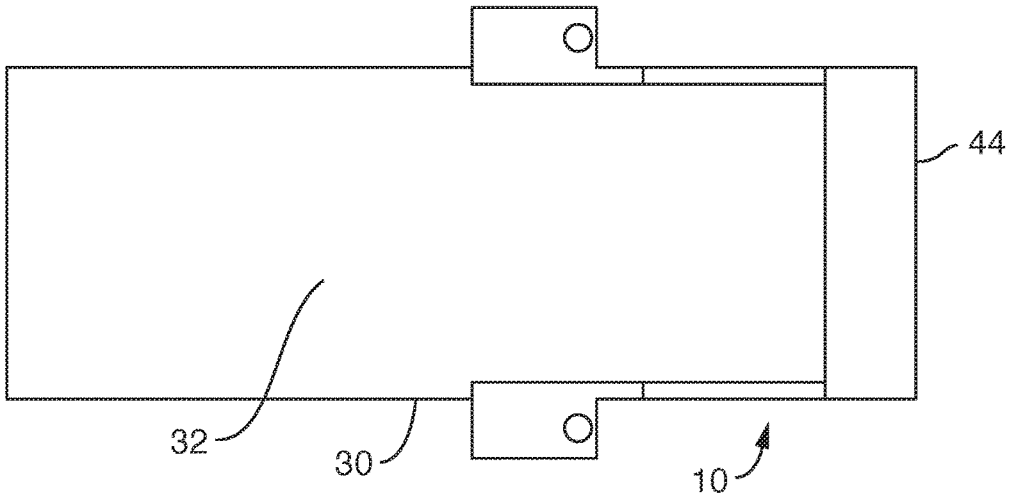
FIG. 6 illustrates a top view thereof.

As shown in FIGS. 1-3, optional housing 30 not only mechanically retains components of lamp module cooling system 10 but also helps define air flow paths. Housing 30 has a cover region 32 which extends at least partially over and across, in a length and width direction, one of said first heat sink 2 or said second heat sink 20. As depicted in FIGS. 1-2, cover 32 extends across the width of, and along a length of, first ribs 8 to help define, or bound, air flow channel 50 (FIG. 3) which has an air inlet region 52 and an air outlet region 54. Optional housing 30 helps keep the air flow close to ribs 8, 28 of the heat sinks until it exits towards the front, and the presence of housing 30 with cover 32 helping to define air flow channel 50 makes the effect of lamp module cooling system 10 more controlled and efficient. Since the top of bezel 110 (FIG. 9) typically conceals light source 12 from direct view, air outlet region 54 is directed slightly downward to pass through aperture 115 for the headlamp optic 130. Housing 30 has mounting regions to couple to vehicle headlamp frame 120 and to align light source 12 with reflector 130.

Figure 10:
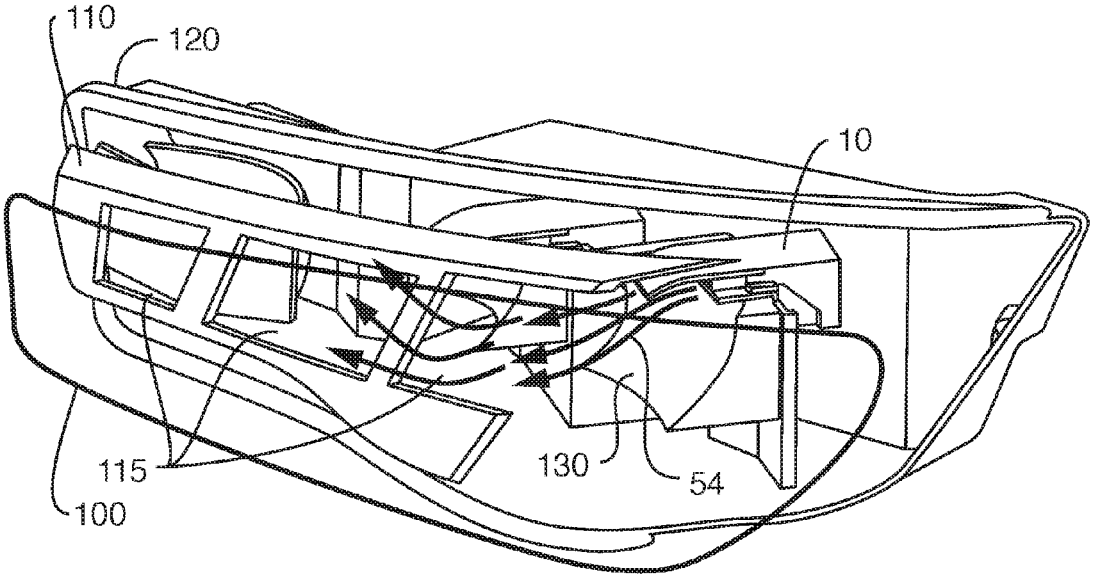
FIG. 10 illustrates a front perspective view thereof with lens cover 100.

With components mounted in operational relationship shown in FIG. 3, and also with reference to FIG. 10, air drawn in through headlamp frame 120 (such as from underneath the vehicle or from the engine compartment) by fan 40 through fan air inlet 44 is forced out fan outlet 42 across second ribs 28 to be received at cover air inlet 52 and directed over first ribs 8 guided through air flow channel 50 and expelled out air outlet 54 of cover 30 and first ribs 8 to be directed towards headlamp lens cover 100, whereby the warmed lens cover 100 can be defogged or de-iced. An additional or secondary airflow 46 exiting fan outlet 42 and passing over second ribs 28 can be directed downwards.

Figure 9:
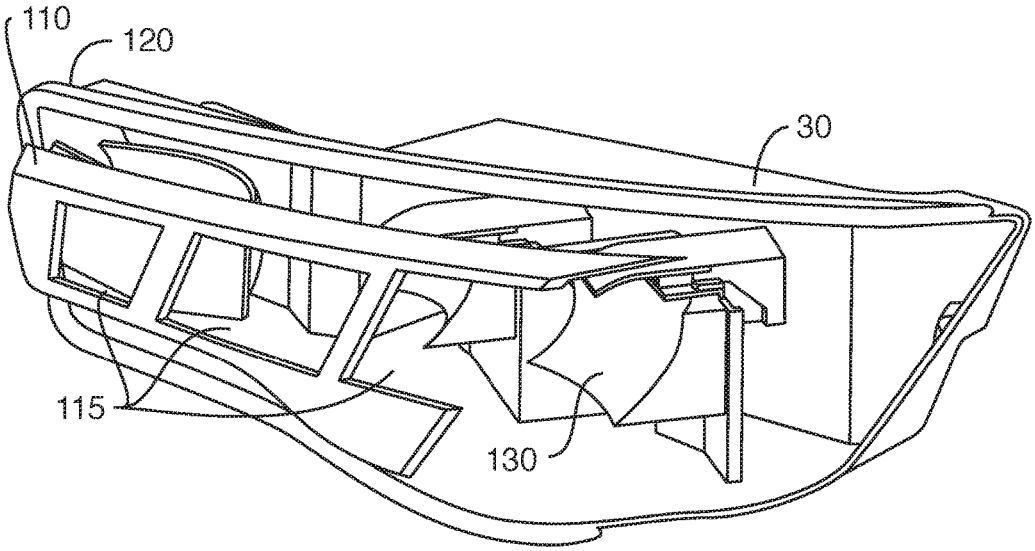
FIG. 9 illustrates a front perspective view thereof with bezel 110.

As shown in FIG. 9, a conventional headlamp frame 120 also supports a styling bezel 110 which provides styling accents visible to users and purchasers from exterior to the vehicle, and also helps conceal a light source, such as lamp module cooling system 10, mounted behind bezel 110. Bezel 110 typically has apertures 115 therein, one for each light source and module 10 with its associated reflector optic 130, two exemplary systems being shown. With the present embodiment of lamp module cooling system 10 it was unnecessary to create additional apertures or ducts in bezel 110; rather, warmed air exiting air outlet 54 is directed to lens cover 100 by flowing out of existing apertures 115.

In operation, outlet flow 54 of warm air to lens cover 100 reduces relative humidity and allows condensation on front lens 100 to be absorbed by the air and transported to cooler section, thereby defogging lens cover 100.

In an embodiment in which first and second heat sinks 2, 20 are extruded from aluminum (such as aluminum of density 2.7 g/cm$^3$), the ribs can be advantageously small, and matched to the footprint of axial fan 40 given the available vertical clearance behind bezel 110 in a top-mount system as depicted in FIGS. 7-10. While a top mount system is illustrated, lamp module cooling system 10 will work equally in a side or bottom mount system or at any angle therebetween, by simply rotating the system about the optical axis. A fan 40 can have a size of 40×40×20 mm delivering 8.9 cfm airflow at full voltage (12V), such as Sunon Model EF40201B1. Extruded second ribs 28 have fins of thickness 1 mm (typical) spaced at 2 mm gaps, with the fins having 20 mm fin height and a fin length along a face of fan outlet 42 corresponding to a full height (40 mm) of fan 40. Extruded first ribs 8 have also fins of thickness 1 mm (typical) spaced at 2 mm gaps, with fins of a 10 mm height, that is, about half the height of the second ribs 28, due to a design goal of compactness in a top mount system where LED light source 12 is close to top of housing 30. First heat sink 2 weighs 35 gram; second heat sink 20 weighs 52 gram; fan 40 weighs 33 gram; housing 30 weighs 22 gram; the LED light source 12 and its PCB 14 weigh 3 gram, thus the major components together providing lamp module cooling system 10 weighing about 145 gram, thus providing a lightweight and compact package.

In appropriate situations, lamp module cooling system 10 can be used not only with a reflector optic 130 but also with a lens optics if the bezel is so constructed that air can go around the lens to be directed at lens cover 100.

While the principles of the present disclosure have been described herein, it is to be understood by those skilled in the art that this description is made by way of example and not as a limitation as to the scope of the embodiments. The features and aspects described with reference to particular embodiments disclosed herein are susceptible to combination and/or application with various other embodiments described herein. Such combinations and/or applications of such described features and aspects to such other embodiments are contemplated herein. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

THE FOLLOWING IS A LIST OF REFERENCE NUMERAL USED IN THE SPECIFICATION:

2 first heat sink
4 first base
6 first exposed surface
8 heat dissipation first ribs
10 lamp module cooling system
12 solid-state light source, e.g. LED
14 printed circuit board (PCB)
18 bolts
20 second heat sink
24 second base
26 second exposed surface
28 heat dissipation second ribs
30 housing
32 cover of housing
34 receptacle cavity (receiving region)
40 fan
42 fan air outlet
44 fan air inlet
46 secondary air flow
50 air flow channel
52 channel inlet
54 warm air outlet flow
100 headlamp lens cover
110 headlamp bezel
115 aperture in bezel
120 headlamp frame
130 headlamp reflector

What is claimed is:

1. A vehicle solid-state lamp module cooling system (10) comprising:

a first heat sink (2) comprising a first extruded material, said first extruded material defining a first base (4) having a first exposed surface (6), said first extruded material further defining a plurality of spaced extruded heat dissipation first ribs (8) extending away from said first base (4) and said first exposed surface (6);

a second heat sink (20) comprising a second extruded material, said second extruded material defining a second base (24), said second extruded material further defining a plurality of spaced extruded heat dissipation second ribs (28) extending away from said second base (24);

a solid-state light source (12) disposed on said first exposed surface (6);

said first heat sink (2) being coupled transverse said second heat sink (20) with said first base (4) in thermal communication with said second base (24); and a fan (40) in fluid communication with said second heat sink (20) and having a fan air outlet (42) positioned in relation to said second ribs (28) such that, when energized, said fan (40) directs air across said second heat sink (20), whereby air drawn over said second ribs (28) is at least partially directed to said first ribs (8), whereby when said lamp module cooling system (10) is positioned proximate a headlamp cover (100) and energized, warmed air exiting a region of said first ribs (8) can be directed at said headlamp cover (100).

2. The vehicle solid-state lamp module cooling system of claim 1, wherein said first and second heat sinks (2, 20) each comprise an aluminum material.

3. The vehicle solid-state lamp module cooling system of claim 1, wherein said first heat sink (2) is a separate component from said second heat sink (20), said first heat sink (2) being coupled to said second heat sink (20).

4. The vehicle solid-state lamp module cooling system of claim 1, wherein said first base (4) is coupled to said second base (24).

5. The vehicle solid-state lamp module cooling system of claim 1, wherein said fan air outlet (42) is disposed in confronting relation to said second ribs (28).

6. The vehicle solid-state lamp module cooling system of claim 1, wherein said fan (40) is coupled to said second heat sink (20).

7. The vehicle solid-state lamp module cooling system of claim 1, wherein said second heat sink (20) comprises a second exposed surface (26), said second exposed surface (26) being disposed laterally adjacent from, and in a different plane from, said first exposed surface (6), said fan (40) being disposed on a side of said second heat sink (20) opposite said second exposed surface (26).

8. The vehicle solid-state lamp module cooling system of claim 1, wherein said fan (40) is a radial fan.

9. The vehicle solid-state lamp module cooling system of claim 1, further comprising a housing (30) coupled to said first and second heat sinks (2, 20), said housing (30) comprising a cover (32) extending across at least a portion of said first heat dissipation ribs (6) thereby defining an air flow channel (50) having an air inlet (52) and an air outlet (54); and whereby said fan (40) is coupled to said housing (30), whereby air drawn over said second ribs (28) is at least partially directed to said air inlet (52) of said air flow channel (50) and across said first heat dissipation ribs (8) towards said air outlet (54), whereby when said lamp module cooling system (10) is positioned proximate a headlamp cover (100) and energized, warmed air exiting said air outlet (54) can be directed at said headlamp cover (100).

10. The vehicle solid-state lamp module cooling system (10) of claim 1, in combination with and mounted to a headlamp frame (120), said headlamp frame (120) having disposed thereon said headlamp cover (100) proximate to and in fluid communication with said lamp module cooling system (10).

11. The vehicle solid-state lamp module cooling system of claim 1, wherein said first ribs (8) extend parallel said second ribs (28).

12. The vehicle solid-state lamp module cooling system of claim 11, wherein said first ribs (8) abut said second ribs (28).

13. The vehicle solid-state lamp module cooling system of claim 1, wherein said fan (40), when energized, directs air across said second heat sink (20) such that a first portion of air drawn over said second ribs (28) is directed to said first ribs (8) and a second portion (46) of air drawn over said second ribs (28) is directed away from said first ribs (8).

14. The vehicle solid-state lamp module cooling system of claim 13, wherein said fan (40) is disposed in confronting relationship to said second base (24).

15. The vehicle solid-state lamp module cooling system of claim 1, wherein said fan (40) is disposed in confronting relationship to said second base (24).

16. A vehicle solid-state lamp module cooling system (10) comprising:

a first heat sink (2) comprising an extruded aluminum material and having a first base (4) defining a first exposed surface (6), said extruded first heat sink (2) further comprising a plurality of spaced first heat dissipation ribs (8) extending away from said first base (4) and said first exposed surface (6);

a second heat sink (20) comprising an extruded aluminum material and having a second base (24), said extruded second heat sink (20) further comprising a plurality of spaced second heat dissipation ribs (28) extending away from said second base (24);

a solid-state light source (12) disposed on one of said exposed surfaces (6, 26);

said first heat sink (2) being coupled transverse said second heat sink (20) with said first base (4) in thermal communication with said second base (24);

a housing (30) coupled to said first and second heat sinks (2, 20), said housing (30) comprising a cover (32) extending across at least a portion of said first heat dissipation ribs (8) thereby defining an air flow channel (50) having an air inlet (52) and an air outlet (54); and a fan (40) coupled to said housing (30) and having a fan air outlet (42) disposed in fluid communication with said second heat dissipation ribs (28) wherein said fan is configured to, when energized, force air across said second heat sink (20), whereby air drawn over said second heat dissipation ribs (28) is at least partially directed to said air inlet (52) of said air flow channel (50) and across said first heat dissipation ribs (8) towards said air outlet (54), whereby when said lamp module cooling system (10) is positioned proximate a headlamp cover (100) and energized, warmed air exiting said air outlet (54) can be directed at said headlamp cover (100).

17. The vehicle solid-state lamp module cooling system of claim 16, wherein said first ribs (8) extend parallel said second ribs (28).

18. The vehicle solid-state lamp module cooling system of claim 17, wherein said first ribs (8) abut said second ribs (28).

19. The vehicle solid-state lamp module cooling system of claim 16, wherein said fan (40), when energized, directs air across said second heat sink (20) such that a first portion of air drawn over said second ribs (28) is directed to said first ribs (8) and a second portion (46) of air drawn over said second ribs (28) is directed away from said first ribs (8).

20. The vehicle solid-state lamp module cooling system of claim 19, wherein said fan (40) is disposed in confronting relationship to said second base (24).

21. The vehicle solid-state lamp module cooling system of claim 16, wherein said fan (40) is disposed in confronting relationship to said second base (24).

22. A method of cooling a vehicle solid-state lamp module, comprising forming a first heat sink (2) defining a first base (4) having a plurality of spaced heat dissipation first ribs (8) extending away therefrom;

forming a second heat sink (20) defining a second base (24) having a plurality of spaced heat dissipation second ribs (28) extending away therefrom;

disposing the first heat sink (2) transversely to the second heat sink (20);

energizing a fan (40) positioned in fluid communication with the second heat sink (20) to force air;

directing forced air across the plurality of second ribs (28) into a first portion of air directed towards the plurality of first ribs (8); and directing forced air across the plurality of second ribs (28) into a second portion (46) of air directed away from the plurality of first ribs (8).

* * * * *